US008177214B2

(12) United States Patent
Sato

(10) Patent No.: US 8,177,214 B2
(45) Date of Patent: May 15, 2012

(54) SHEET PROCESSING APPARATUS

(75) Inventor: Hiroyasu Sato, Machida (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 116 days.

(21) Appl. No.: 12/784,551

(22) Filed: May 21, 2010

(65) Prior Publication Data

US 2010/0301541 A1 Dec. 2, 2010

(30) Foreign Application Priority Data

May 26, 2009 (JP) ..... 2009-126241

(51) Int. Cl.
*B65H 37/04* (2006.01)

(52) U.S. Cl. ..... 270/58.09; 270/52.18; 270/58.07; 270/58.08

(58) Field of Classification Search ..... 270/52.18, 270/58.07, 58.08, 58.09
See application file for complete search history.

(56) References Cited

U.S. PATENT DOCUMENTS

| | | | | |
|---|---|---|---|---|
| 5,187,534 | A * | 2/1993 | Iwata et al. | 399/410 |
| 6,550,757 | B2 * | 4/2003 | Sesek | 270/58.09 |
| 6,595,509 | B2 * | 7/2003 | Sesek | 270/58.09 |
| 7,281,707 | B2 * | 10/2007 | Moriyama et al. | 270/58.04 |
| 7,413,177 | B2 * | 8/2008 | Mori et al. | 270/58.09 |

FOREIGN PATENT DOCUMENTS

| | | | |
|---|---|---|---|
| JP | 11-305589 | A | 11/1999 |
| JP | 2007-017507 | A | 1/2007 |

* cited by examiner

*Primary Examiner* — Leslie A Nicholson, III
(74) *Attorney, Agent, or Firm* — Buchanan Ingersoll & Rooney PC

(57) ABSTRACT

A sheet processing apparatus including: a stapler capable of performing a staple processing for sheets with plural staple modes; and a control section that determines a maximum number of sheets that can be processed in single staple processing with one staple mode of the plural staple modes, wherein the control section determines the maximum number of sheets differing from a maximum number of sheets in another staple mode of the plural staple modes.

6 Claims, 7 Drawing Sheets

SHEET PROCESSING APPARATUS

This application is based on Japanese Patent Application No. 2009-126241 filed on May 26, 2009, in Japanese Patent Office, the entire content of which is hereby incorporated by reference.

BACKGROUND

1. Field of the Invention

The present invention relates to a sheet processing apparatus that carries out staple processing for a sheet.

2. Description of Related Art

As a sheet processing apparatus that carries out post-processing such as image forming processing and staple processing for a sheet, there is known a sheet processing apparatus equipped with a high speed image forming apparatus such as an electrophotographic image forming apparatus.

When stapling a bundle of sheets by using a staple for stapling, there is a limit in a thickness of a bundle of sheets that can be stapled by a staple for stapling.

In Unexamined Japanese Patent Application Publication No. 11-305589, there is proposed a technology wherein a type of a transfer sheet is detected, and a maximum number of sheets which can be stapled is determined based on results of the detection.

In Unexamined Japanese Patent Application Publication No. 2007-17507, there is proposed a technology wherein characteristics of sheets other than a thickness of sheets to be stapled are detected, and a maximum number of sheets for staple processing is determined based on results of the detection.

SUMMARY OF THE INVENTION

Staple processing includes plural types of staple processing modes such as one for stapling at one position, one for stapling at two positions and one for stapling at three or more positions.

It was found out from experiments made by the inventors of the invention that behaviors of a sheet in a sheet ejection section vary depending on a difference of staple modes.

The difference mentioned above will be explained as follows, referring to FIGS. 1*a* and 1*b*.

For example, when sheets are stapled at positions which are symmetrical about center line CL in the width direction perpendicular to sheet conveyance direction W, like the one for stapling at two positions shown with STA, the sheets advance straight in sheet conveyance direction W to be ejected smoothly to sheet-ejection tray HT. In contrast to this, when sheets are stapled at positions which are not symmetrical about center line in the width direction, like one for stapling at one position shown with STB, there is caused a difference of conveyance force of sheet-ejection roller EXR between the left side and the right side of the center line CL, and a sheet is ejected while it is inclined as shown in SB.

As a result, it has become clear that sheets are stacked on sheet-ejection tray HT in the irregular state, and in some cases, sheet ejection jam, namely, sheet jam in sheet ejection section is caused.

It has been cleared that this trouble tends to be caused when a thickness of a bundle of sheets to be ejected grows greater. Therefore, it has become clear that a limitation of the maximum number of sheets that can be processed corresponding to a type of staple processing is needed for the purpose of avoiding the trouble caused in the sheet ejection section.

Namely, when only the maximum number of sheets in staple processing is decided corresponding to a thickness of a sheet bundle and a type of sheets, as in Patent Documents 1 and 2, it is impossible to prevent the trouble in the sheet ejection section stated above.

One aspect of the invention is as follows.

Item 1. A sheet processing apparatus comprising: a stapler capable of performing a staple processing for sheets with plural staple modes; and a control section that determines a maximum number of sheets that can be processed in single staple processing with one staple mode of the plural staple modes, wherein the control section determines the maximum number of sheets differing from a maximum number of sheets in another staple mode of the plural staple modes.

Item 2. The sheet processing apparatus described in the claim 1, wherein the plural staple modes include a mode for stapling at one position and a mode for stapling at two or more positions; and wherein the control section makes the maximum number of sheets in the mode for stapling at one position to be different from a maximum number of sheets in the mode for stapling at two or more positions.

Item 3. The sheet processing apparatus described in claim 1, wherein the control section determines the maximum number of sheets corresponding to a thickness of a sheet.

Item 4. The sheet processing apparatus described in claim 1, wherein the control section determines the maximum number of sheets corresponding to a sheet size.

Item 5. The sheet processing apparatus described in claim 1, wherein the control section determines the maximum number of sheets corresponding to a sheet type.

Item 6. The sheet processing apparatus described in claim 1, further comprising: a drive roller; a driven roller that is in pressure contact with the drive roller; and a sheet ejection section that ejects a bundle of sheets that has been subjected to staple processing by the stapler.

Item 7. The sheet processing apparatus described in claim 1, comprising: an image forming apparatus that forms an image on a sheet; and a post-processing apparatus that receives a sheet ejected from the image forming apparatus and performs at least the staple processing.

DETAILED DESCRIPTION OF THF, PREFERRED EMBODIMENT

The invention will be explained as follows based on an embodiment of the invention to which, however, the invention is not limited.

Figure 2:
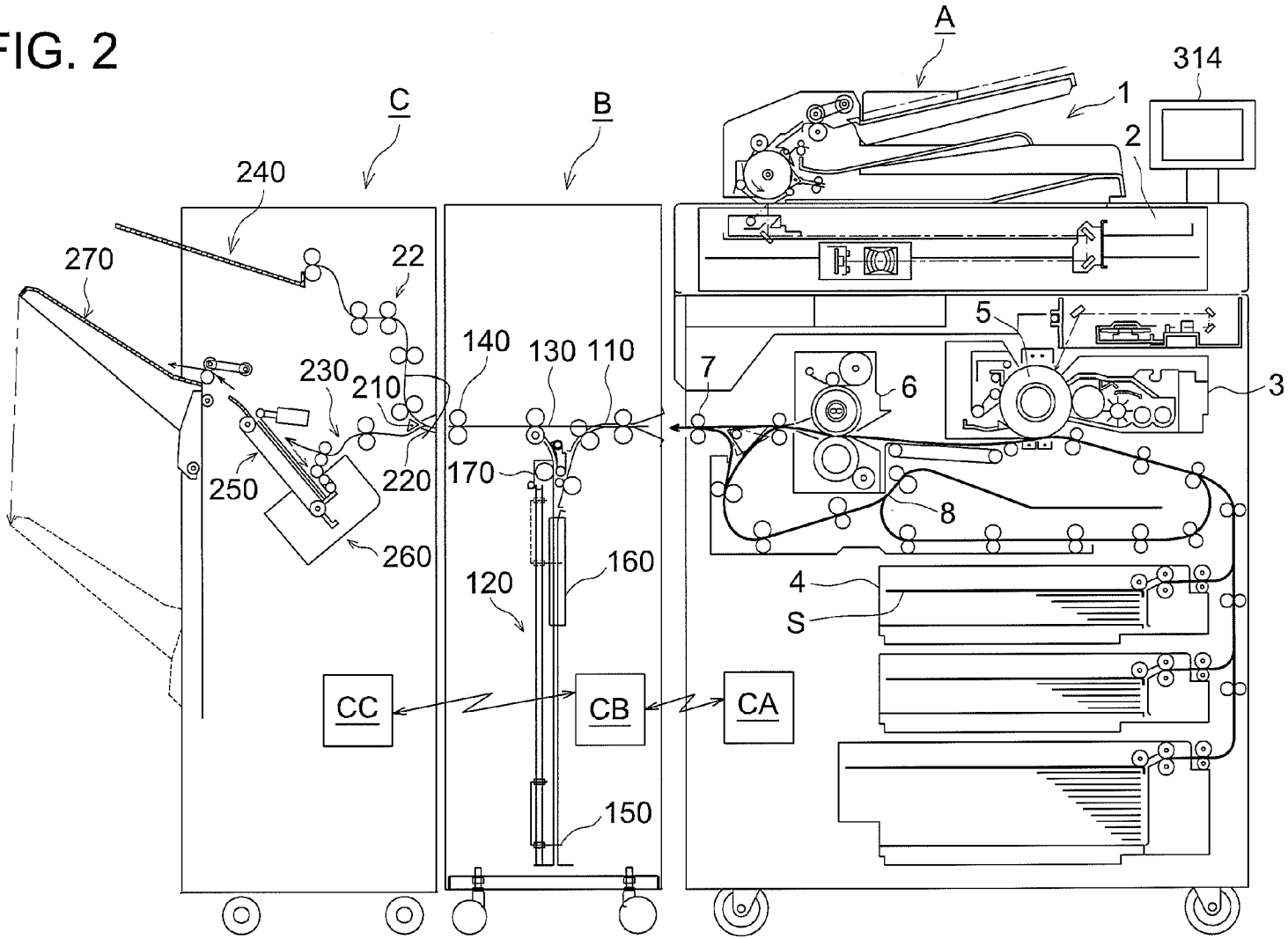
FIG. 2 is a whole construction diagram of a sheet processing apparatus having therein image forming apparatus A, first post-processing apparatus B and second post-processing apparatus C.

FIG. 2 is a whole construction diagram of a sheet processing apparatus having therein image forming apparatus A, first post-processing apparatus B and second post-processing apparatus C. The first post-processing apparatus B is positioned between the image forming apparatus A and the second post-processing apparatus C to be connected thereto. Further, the image forming apparatus A has control device CA, the first post-processing apparatus B has control device CB and the second post-processing apparatus C has control device CC respectively, and each control device exchanges messages with other devices to control each apparatus.

[Image Forming Apparatus A]

The image forming apparatus A has, on its upper portion, automatic document conveyance device 1 and image reading section 2, and a lower portion of the image forming apparatus A is composed of printer section 3.

The numeral 4 in the printer section 3 represents a sheet storage section that stores sheets S. A toner image formed on photoconductor 5 by an electrophotographic process is transferred onto sheet S supplied from the sheet storage section 4, and the image thus transferred is fixed in fixing unit 6. The sheet S after being fixed is ejected from a sheet ejection outlet by sheet ejection roller 7. When the sheet S is ejected with its image carrying surface facing downward, the sheet S is conveyed downward at a position of this side of the sheet ejection roller 7 to be ejected by the sheet ejection roller 7 after being reversed inside out.

In the case of two-sided copying, the sheet S is conveyed downward at a position of this side of the sheet ejection roller 7, to advance through two-sided conveyance path 8 to be returned to the transfer position again, thus, an image is formed on the back side of the sheet S.

The numeral 314 represents an operation display section that is equipped with a touch panel wherein a touch screen is arranged to be overlapped on a display section composed of a liquid crystal panel. It is possible to perform various input of numerical values and mode setting in image forming apparatus A and to perform setting of output mode employing the second post-processing apparatus C, from the operation display section 314. Pieces of information including set numerical values and modes are sent to each control device to become a parameter for control.

Sheet S ejected from image forming apparatus A is conveyed to second post-processing apparatus C through the first post-processing apparatus B.

[First Post-Processing Apparatus B]

The first post-processing apparatus B is provided for the purpose of enhancing productivity of a sheet processing apparatus that is composed of image forming apparatus A and the second post-processing apparatus C, thus it can also be said an intermediate conveyance apparatus, because it is provided in a position between the image forming apparatus A and the second post-processing apparatus C. Incidentally, it is also possible to construct a sheet processing apparatus with only the image forming apparatus A and the second post-processing apparatus C, by omitting first post-processing apparatus B.

The first post-processing apparatus B is one wherein a sheet conveyed from image forming apparatus A is overlapped to be in a two-ply type by sheet overlapping section 120, and two sheets are made to be one set in which two sheets are overlapped, and they are conveyed to second succeeding post-processing apparatus C as one set. By sending two sheets in a two-ply form like this, an interval for sheet conveyance to the second post-processing apparatus C can be increased, thereby, post-processing time in the second post-processing apparatus C can be secured.

The first post-processing apparatus B is composed of sheet carrying-in section 110, sheet overlapping section 120, by-pass conveyance section 130 and of sheet carrying-out section 140. In the sheet overlapping section 120, there are arranged lower end stopper 150, width alignment member 160 and upper end stopper 170.

When overlapping two sheets, first sheet S coming from image forming apparatus A is stored in the sheet overlapping section 120 that has two guide plates first. In this case, the lower end stopper 150 is located at the position corresponding to a sheet size to hold a lower end of the sheet S. Then, when second sheet S comes, the lower end stopper 150 rises slightly so that the second sheet may not collide with the first sheet. When the second sheet enters the sheet overlapping section 120, the lower end stopper 150 goes down again to stack these two sheets under the condition that these two sheets are overlapped.

Next, the lower end stopper 150 goes up under the condition that upper end stopper 170 is in the conveyance path, so that a leading edge of a sheet hits the upper end stopper 170 to be aligned in the conveyance direction. Then, simultaneously with this, or after this, width alignment members 160 arranged on both ends of the sheet overlapping section 120 in the sheet width direction hit these two sheets slightly in the width direction to align them.

After a termination of the alignment for sheets in both the conveyance direction and the sheet width direction, the upper end stopper 170 retreats, and the two sheets are pushed up by the lower end stopper 150 under the condition that these two sheets are overlapped, to be sent from sheet carrying-out section 140 to second post-processing apparatus C. After these overlapped two sheets have left the sheet overlapping section 120, third sheet S enters the sheet overlapping section 120 to undergo the same processing as the foregoing thereafter.

When processing for overlapping is not carried out, a sheet carried in from sheet carrying-in section 110 is sent to the second post-processing apparatus C from sheet carrying-out section 140 through by-pass conveyance section 130.

[Second Post-Processing Apparatus C]

First, second post-processing apparatus C will be explained as follows, referring to FIG. 2. Sheet S sent from first post-processing apparatus B is received at introduction inlet 200, and then is guided to first conveyance path 220 or to second conveyance path 230 through conveyance path switching member 210.

Sheet S guided to the first conveyance path 220 is ejected to fixed sheet ejection tray 240 without undergoing post-processing. On the other hand, sheet S guided to the second conveyance path 230 is stacked on stacking section 250 to form a part composed of plural sheets constituting the part, and then, the part is stapled by stapler 260, and after that, the part is ejected to elevating sheet ejection tray 270. The elevating sheet ejection tray 270 goes down each time a sheet is ejected, to be capable of taking in large quantities of sheets.

Figure 3:
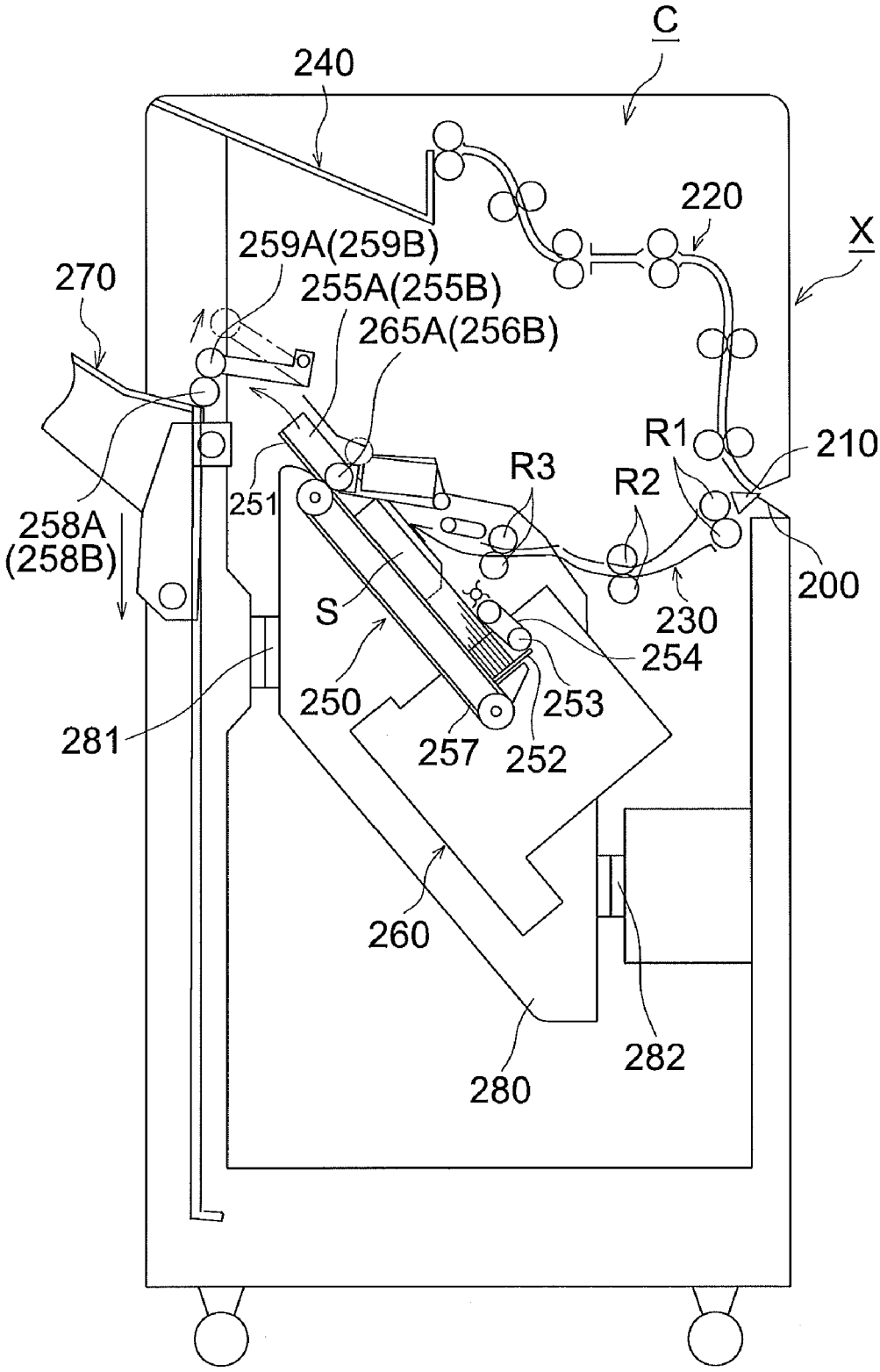
FIG. 3 is a perspective view of the second post-processing apparatus C.
Figure 4:
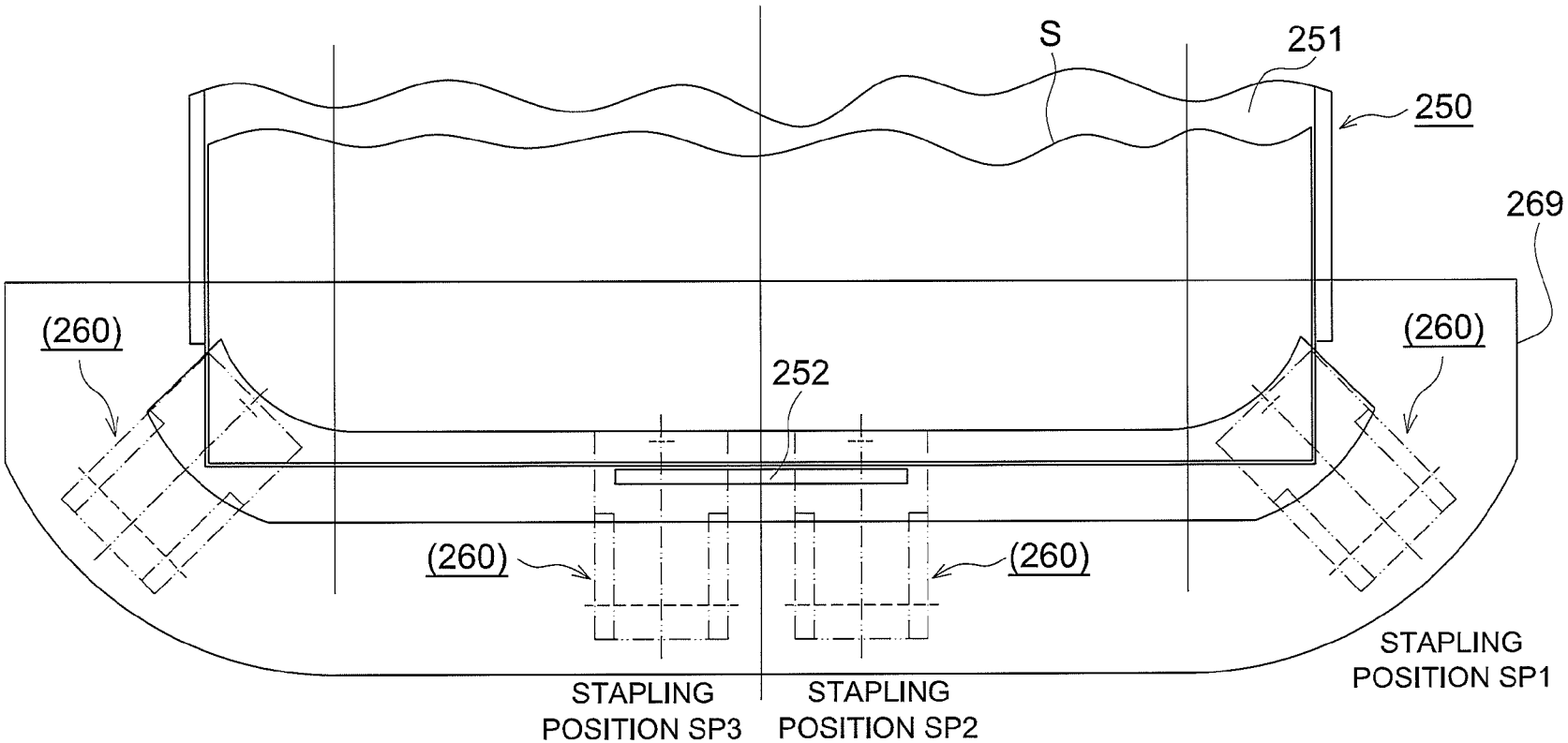
FIG. 4 is a top view for stacking section 250 and for stapler 260.

The second post-processing apparatus will further be explained as follows, referring to FIGS. 3 and 4. FIG. 3 is a sectional view of the second post-processing apparatus C, and FIG. 4 is a top view for stacking section 250 and stapler 260, and explanations will be given as follows, referring to both diagrams.

On the second conveyance path 230, there are arranged conveyance rollers R1, R2 and R3, and these conveyance rollers send sheet S coming from the first post-processing apparatus B to stacking section 250.

The stacking section 250 is inclined, and it has therein sheet supporting plate 251 that extends in the conveyance direction, roller 253 that guides sheet S that has been fed in toward stopper 252, guide belt 254, stopper 252 by which a lower portion of the fed-in sheet S is caught and right and left alignment regulating members 255A and 255B.

The sheet supporting plate 251 is composed of two plate-like members which are divided in the direction perpendicular to the sheet conveyance direction. On belt member 257, there is fixed stopper 252, and the stopper 252 catches sheet S and pushes it upward to the left in each of FIGS. 2 and 3 by holding an edge face of a sheet by movement of the belt member 257.

On a leading edge position (upper edge position) of the sheet supporting plate 251, there are arranged drive-out rollers 256A and 256B each being supported to be capable of being in contact with or being in away from the sheet supporting plate 251, and further on a sheet ejection section at a downstream side in the conveyance direction, there are arranged sheet ejection drive rollers 258A and 258B and sheet ejection driven rollers 259A and 259B. The sheet ejection driven roller 259A is in pressure-contact with the sheet ejection drive roller 258A with its empty weight and the sheet ejection driven roller 259B is in pressure-contact with the sheet ejection drive roller 258B with its empty weight. When a bundle of sheets S passes through the sheet ejection section, the sheet ejection driven roller 259A and the sheet ejection driven roller 259B are pushed by the bundle of sheets S to be moved upward as shown with dotted lines.

Conveyance roller, stacking section 250, stapler 260 and members constituting the aforesaid items are held on supporting plate 280 in about a direction perpendicular to the page in FIG. 3, and the supporting plate 280 is constructed to be a unit that can be drawn out in the direction to this side of the apparatus by slide rails 281 and 282. When the unit is drawn out, staples for stapling can be replenished and jam can be cleared.

Incidentally, those which are shown by adding parenthesized symbols like 255A (255B) show that plural members are arranged in parallel in the width direction perpendicular to the sheet conveyance direction.

Sheet S that is conveyed by conveyance roller R3 and travels on stacking section 250 in the direction toward upper left advances along a supporting surface of sheet supporting plate 251. After the trailing edge of sheet S has left the conveyance roller R3, an advancing direction of sheet S is reversed, and sheet S slides down on the sheet supporting plate 251 to hit stopper 252, and it stops. The sheet S is pressed downward with slight pressure by roller 253 and guide belt 254. As a result, a upper end of sheet S in an upper side of plural sheets and a bottom end of sheet S in a lower side of plural sheets S hit stopper 252, thus, sheets are aligned surely.

On FIG. 4, there is shown a position of stapling of stapler 260. The stapler 260 is arranged so that it can move to be in parallel with a surface of stapler supporting substrate 269, and can move along sheet trailing edge stopper 252 of stacking section 250. It is possible to cause the stapler 260 to move to stapling positions SP1, SP2 and SP3 as illustrated plural prescribed positions. The stapler supporting substrate 269 is composed of a plate-like member that is long in the width direction that is perpendicular to the sheet conveyance direction as illustrated.

A home position of stapler 260 is stapling position SP1, and the stapling position SP1 is located at an inner part of a sheet processing apparatus.

The stapler 260 moves from the stapling position SP1 representing a home position, in the width direction perpendicular to the direction of sheet conveyance and is set to stapling position SP2 or SP3.

When the stapler 260 staples at the stapling position SP1, there is conducted staple processing for stapling at one position that is called a corner stapling. In the same way, when stapling is conducted at each of the stapling positions SP2 and SP3, there is carried out staple processing for stapling at two positions. Incidentally, in the case of staple processing for stapling at central two stapling positions SP2 and SP3, the stapler 260 conducts stapling at either one of stapling position SP2 and stapling position SP3 first, and then, movable stapler 260 is moved to a stapling position where no stapling has been conducted, and the second stapling is carried out. It is further possible to conduct stapling for plural positions such as stapling for three positions or the like, which, however, is not illustrated.

Figure 5:
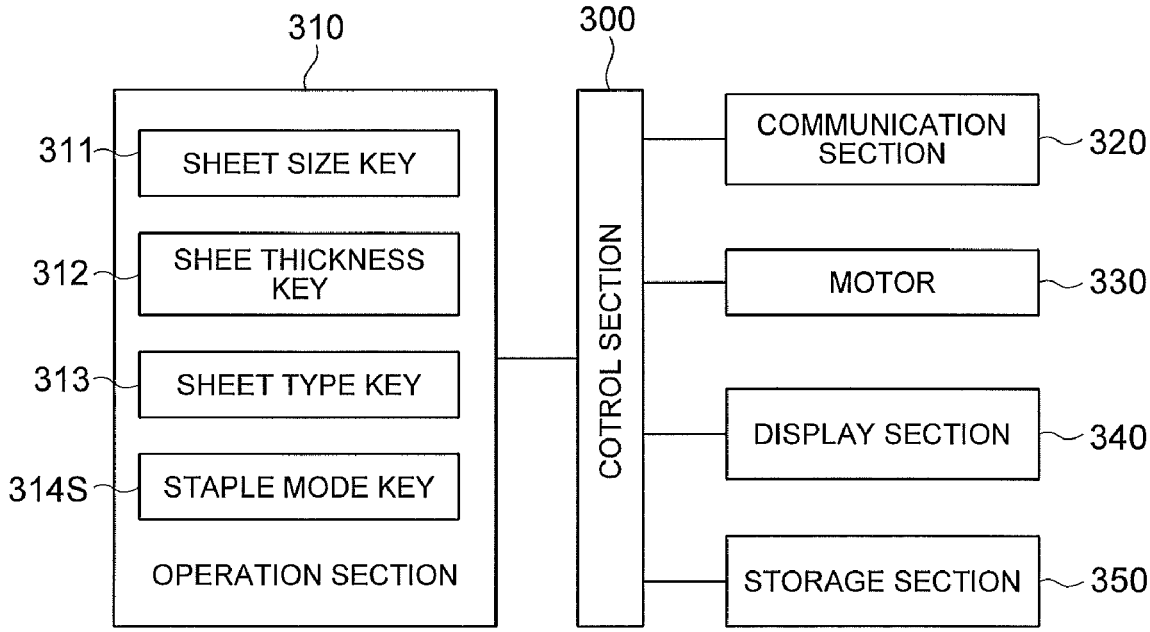
FIG. 5 is a block diagram of a control system for a sheet processing apparatus.

FIG. 5 is a block diagram of a control system for a sheet processing apparatus.

The numeral 300 represents a control section that controls a sheet processing apparatus on the whole, and it includes control devices CA, CB and CC shown in FIG. 2. The numeral 310 represents an operation section where staple modes, sheet sizes, sheet thicknesses and sheet types are designated. A communication section that communicates with outer equipment such as a personal computer or the like is represented by 320, and it receives instructions for printing from outer equipment and generates pieces of information such as a staple mode, a sheet size, a sheet thickness and a sheet type. The numeral 330 represents a motor that moves stapler 260 in the longitudinal direction of stapler supporting substrate 269 in FIG. 3 and thereby sets the stapler 260 at a position corresponding to the staple mode set by the staple mode key.

The numeral 340 represents a display section that indicates a dialogue screen in the case of designating a staple mode that is to be explained next.

Figure 1A:
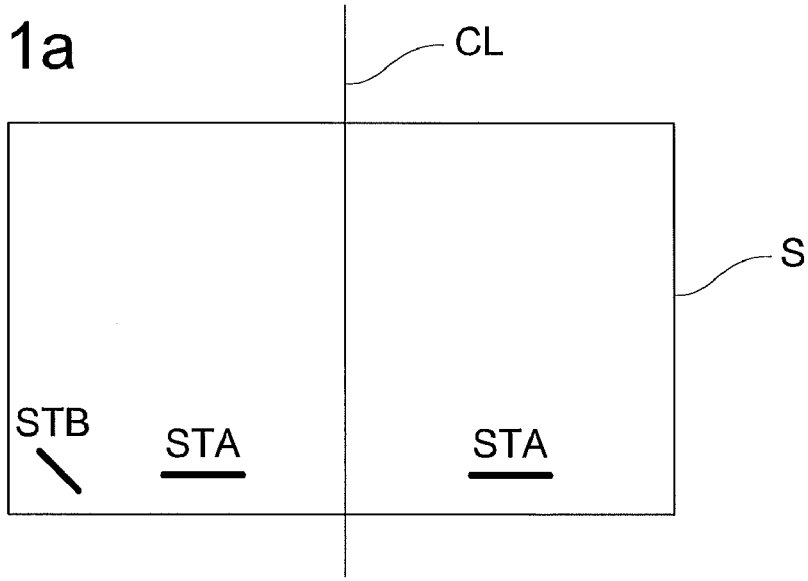
FIGS. 1*a* and 1*b* are a diagram illustrating a behavior of a bundle of staple-processed sheets in a sheet ejection section.
Figure 1B:
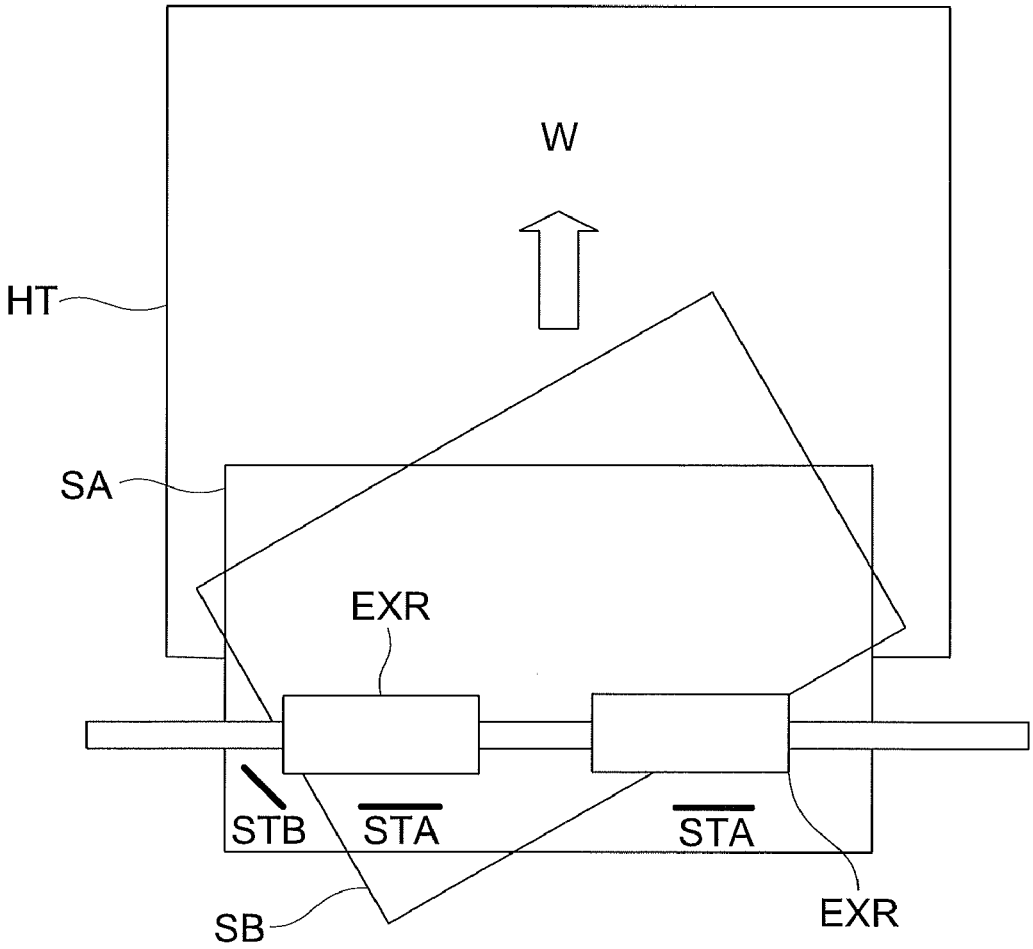
Figure 6:
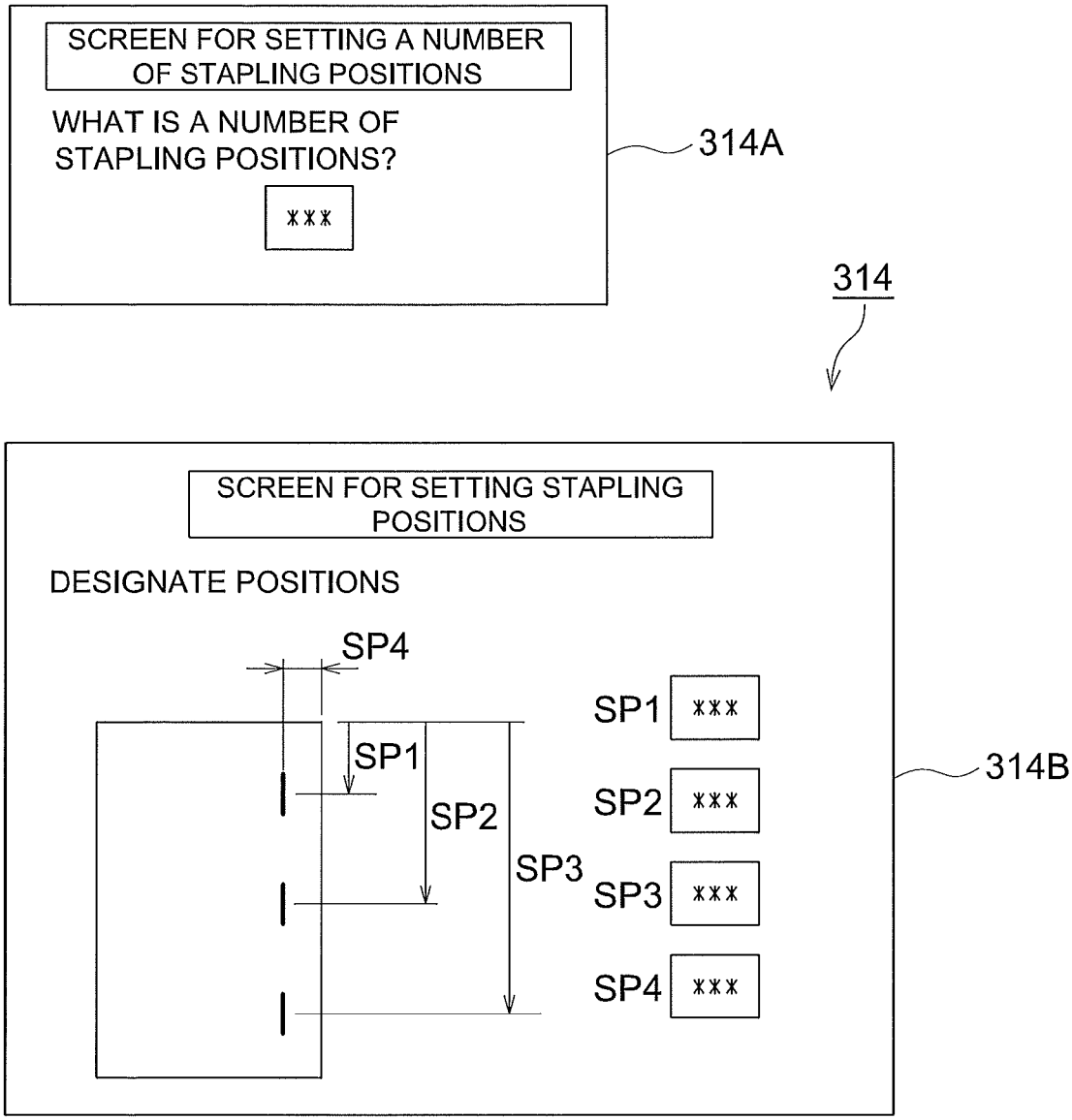
FIG. 6 is a diagram showing a display screen of operation display section 314.

FIG. 6 shows a display screen for operation display section 314 having therein operation section 310 and display section 340 in FIG. 5 (see FIGS. 1*a* and 1*b*) together. An operator designates the number of staples in display 314A. Namely, the number of staples is set by inputting numerical values for an indication asking "the number of positions for stapling".

It is further possible to designate positions of SP1, SP2 and SP3 respectively with numerical values by using indication 314B. This position is inputted as a position from an upper end of a sheet. It is further possible to input a stapling position from the right end of the sheet by using indication SP4.

Information corresponding to designation information of staple modes shown in FIG. 5 is inputted in control section 300 also from communication section 320.

After a staple mode is set, an image is formed on a sheet by a start of image forming, and staple processing is conducted by the designated staple mode in second post-processing apparatus C.

Though stapling is processing to staple sheets by using staples for stapling, the maximum number of sheets which can be stapled through a single staple processing varies depending on a sheet size, a sheet thickness and a sheet type. Further, the maximum number of sheets which can be stapled by a single staple processing varies depending on a staple mode. For example, there is a difference of the maximum number of sheets between stapling at one position and stapling at two positions.

Table 1 shows an example of the maximum number of sheets that can be stapled. Table 1 represents the maximum number of sheets applied to staples for stapling having a specific size.

TABLE 1

| Basis weight | | Sheet size: Stapling at one position: Other than those mentioned on the right (Sheet length 399 mm or less) | Stapling at one position: A3, 11 × 17 (Sheet length 400 mm or more) | Stapling at two positions: Other than those mentioned on the right (Sheet length 399 mm or less) | Stapling at two positions: A3, 11 × 17 (Sheet length 400 mm or more) |
|---|---|---|---|---|---|
| Plain paper | 40-49 g/m$^2$ | — | — | — | — |
| Fine-quality paper | 50-61 g/m$^2$ | 100 | 50 | 100 | 50 |
| | 62-71 g/m$^2$ | 100 | 50 | 100 | 50 |
| | 72-80 g/m$^2$ | 100 | 50 | 100 | 50 |
| | 81-91 g/m$^2$ | 60 | 30 | 60 | 30 |
| | 92-105 g/m$^2$ | 50 | 25 | 50 | 25 |
| | 106-130 g/m$^2$ | 30 | 15 | 50 | 25 |
| | 131-161 g/m$^2$ | 10 | 5 | 40 | 20 |
| | 162-216 g/m$^2$ | 10 | 5 | 25 | 12 |
| | 217-244 g/m$^2$ | 10 | 5 | 25 | 12 |
| | 245-300 g/m$^2$ | — | — | — | — |
| Rough paper | 40-49 g/m$^2$ | — | — | — | — |
| | 50-61 g/m$^2$ | 30 | 15 | 30 | 15 |
| | 62-71 g/m$^2$ | 30 | 15 | 30 | 15 |
| | 72-80 g/m$^2$ | 30 | 15 | 30 | 15 |
| | 81-91 g/m$^2$ | 15 | 7 | 15 | 7 |
| | 92-105 g/m$^2$ | 10 | 5 | 10 | 5 |
| | 106-130 g/m$^2$ | 10 | 5 | 10 | 5 |
| | 131-161 g/m$^2$ | 5 | 5 | 5 | 5 |
| | 162-300 g/m$^2$ | — | — | — | — |

As shown in Table 1, the maximum number of sheets varies depending on a sheet thickness (basis weight), a sheet size and a sheet type (difference between a group including plain paper and fine-quality paper and a group of rough paper).

The following is a reason for the difference of the maximum number of sheets.

When a sheet thickness varies, the number of sheets constituting a bundle of sheets each having the same thickness varies, thus, the maximum number of sheets varies depending on the sheet thickness. When a sheet size varies, a weight of a sheet-bundle having the same thickness varies. When a weight varies, required stapling strength varies. Due to this, it is necessary to make the maximum number of sheets to be different depending on sheet sizes. When sheet type varies, the number of sheets constituting a sheet bundle having the same thickness varies, and a weight of one bundle varies despite the same thickness. Owing to this, it is necessary to change the maximum number of sheets depending on the sheet type.

As is shown in Table 1, even in the case of the same sheet thickness, the same sheet type and the same sheet size, different maximum numbers for sheets are assigned to stapling at one position and to stapling at two positions respectively.

As stated above, the maximum number of sheets is made to be different depending on the staple mode, which dissolves troubles caused in the sheet ejection section which were explained in the column of the problem to be solved by the invention.

Namely, though a sheet bundle for stapling at one position and a sheet bundle for stapling at two positions sometimes show different behaviors respectively, irregular sheet ejection and sheet ejection jam can be prevented sufficiently, by setting the number of sheets that is not larger than the maximum number of sheets shown in Table 1, as the number of sheets to be staple-processed.

In the storage section 350 composed of a nonvolatile memory, there is stored Table 1, and control section 300 determines the maximum number of sheets in stapling by referring to Table of storage section 350, based on information from operation section 310 or from communication section 320. Incidentally, in the storage section 350, there is stored a plurality of tables each corresponding to staples having a different size, and when using the staples having a different size, a table corresponding to the staples to be used can be referred from the storage section 350. And each of the plurality of tables corresponds to the Table 1.

Figure 7:
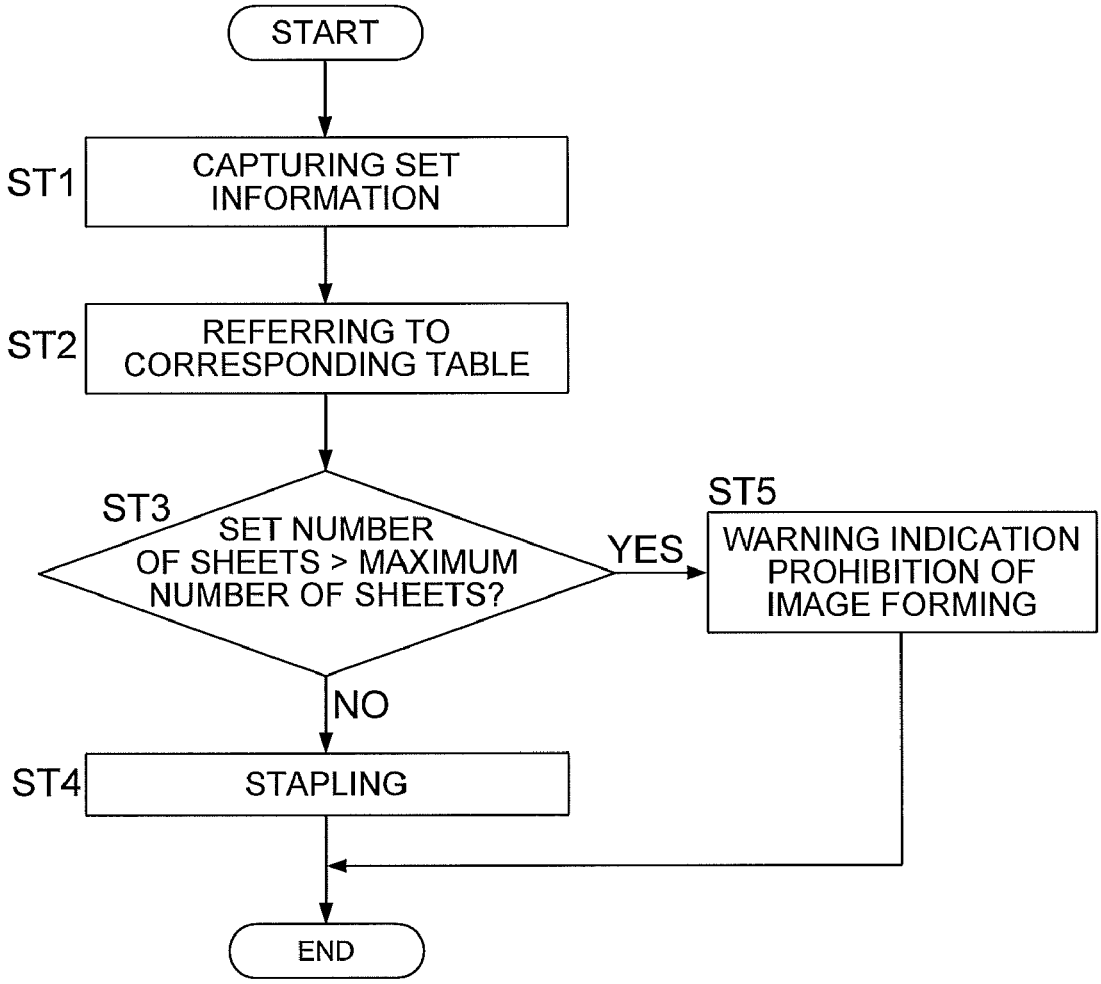
FIG. 7 is a flow chart of control in a sheet processing apparatus relating to the embodiment of the invention.

FIG. 7 is a flow chart of control in a sheet processing apparatus relating to the embodiment of the invention.

In step ST1, the control section 300 obtains information about image forming job including staple processing from operation section 310 or from communication section 320. This information includes information of staple modes such as stapling at one position or stapling at plural positions and information about a sheet size, a sheet thickness and a sheet type.

In step ST2, the maximum number of sheets in stapling is determined by referring to the table corresponding to Table 1 stored in the storage section 350.

In step ST3, the number of sheets which has been set is judged whether it is exceeding the maximum number of sheets in Table 1 or not, and when it is not exceeding (No in ST3), operations of image forming including stapling are carried out in step ST4.

When the number of sheets which has been set is exceeding (Yes in ST3), a warning is given on display section 340 to urge resetting, and image forming is prohibited.

In the present example, the maximum number of sheets in staple processing is changed depending on staple modes. Owing to this, it is possible to prevent sheet ejection jam wherein staple-processed sheets are jammed in the sheet ejection section and to prevent troubles wherein sheets are ejected on a sheet-ejection tray without being aligned, thereby, a sheet processing apparatus capable of performing staple processing stably can be realized.

What is claimed is:

1. A sheet processing apparatus comprising:

a stapler capable of performing a staple processing for sheets with plural staple modes, wherein the plural staple modes include a mode for stapling at one position and a mode for stapling at two or more positions; and a control section that determines a maximum number of sheets that can be processed in single staple processing with one staple mode of the plural staple modes, wherein the control section makes the maximum number of sheets in the mode for stapling at one position to be different from a maximum number of sheets in the mode for stapling at two or more positions.

2. The sheet processing apparatus described in claim 1, wherein the control section determines the maximum number of sheets corresponding to a thickness of a sheet.

3. The sheet processing apparatus described in claim 1, wherein the control section determines the maximum number of sheets corresponding to a sheet size.

4. The sheet processing apparatus described in claim 1, wherein the control section determines the maximum number of sheets corresponding to a sheet type.

5. The sheet processing apparatus described in claim 1, further comprising: a drive roller; a driven roller that is in pressure contact with the drive roller; and a sheet ejection section that ejects a bundle of sheets that has been subjected to staple processing by the stapler.

6. The sheet processing apparatus described in claim 1, comprising: an image forming apparatus that forms an image on a sheet; and a post-processing apparatus that receives a sheet ejected from the image forming apparatus and performs at least the staple processing.

* * * * *